US011708694B2

(12) United States Patent
Srbinovski et al.

(10) Patent No.: US 11,708,694 B2
(45) Date of Patent: Jul. 25, 2023

(54) INTER-TENANCY PARTITIONING SYSTEM

(71) Applicant: STONEWALL PLATINUM PTY LTD, Keilor Park (AU)

(72) Inventors: Paul Srbinovski, Werribee (AU); Michael Fortunato, Essendon (AU); Luca Fortunato, Aberfeldie (AU)

(73) Assignee: STONEWALL PLATINUM PTY LTD, Keilor Park (AU)

( * ) Notice: Subject to any disclaimer, the term of this patent is extended or adjusted under 35 U.S.C. 154(b) by 223 days.

(21) Appl. No.: 17/296,181

(22) PCT Filed: Feb. 26, 2020

(86) PCT No.: PCT/AU2020/050170
§ 371 (c)(1),
(2) Date: May 21, 2021

(87) PCT Pub. No.: WO2020/172711
PCT Pub. Date: Sep. 3, 2020

(65) Prior Publication Data

US 2022/0025647 A1 Jan. 27, 2022

(30) Foreign Application Priority Data

Feb. 28, 2019 (AU) ..... 2019900637

(51) Int. Cl.
*E04B 2/72* (2006.01)

(52) U.S. Cl.
CPC ..... *E04B 2/723* (2013.01); *E04B 2103/02* (2013.01)

(58) Field of Classification Search
CPC .... E04B 2/723; E04B 2103/02; E04B 2/7403; E04B 1/948; E04B 2/789; E04B 2/825;
(Continued)

(56) References Cited

U.S. PATENT DOCUMENTS 3,255,563 A 6/1966 Sauer
3,343,314 A 9/1967 Smith
(Continued)

FOREIGN PATENT DOCUMENTS

CA 911123 A 10/1972
CA 2002674 A1 5/1991
(Continued)

OTHER PUBLICATIONS

International Preliminary Report on Patentability dated Mar. 1, 2021 from PCT Application No. PCT/AU2020/050170.
(Continued)

*Primary Examiner* — Patrick J Maestri

(74) *Attorney, Agent, or Firm* — Innovation Capital Law Group, LLP; Vic Lin

(57) ABSTRACT

An inter-tenancy partitioning system installed between floor and ceiling slabs has aligned dual spaced apart ceiling and floor channels formed by channel forming members. Dual panels are supported vertically within the aligned dual ceiling and floor channels Each panel having a width less than that of each channel and the channels are spaced apart to provide a gap between the panels. The panels have a height of greater than 2800 mm and extend through a suspended ceiling to engage the respective channel forming members at the ceiling slab above the suspended ceiling. Outer vertical pieces of the channel forming members of the floor channels have a height that does not extend vertically beyond an upper surface of the adjacent floor covering.

14 Claims, 3 Drawing Sheets

(58) Field of Classification Search
CPC ... E04B 2/74; E04B 2/821; E04B 2/92; E04C 2/48; E04C 2/288
See application file for complete search history.

(56) References Cited

U.S. PATENT DOCUMENTS

| | | | | | |
|---|---|---|---|---|---|
| 3,386,216 | A | | 6/1968 | Zwickert | |
| 3,623,290 | A | * | 11/1971 | Downing, Jr. | E04B 2/7854 52/762 |
| 4,196,555 | A | | 4/1980 | Henges et al. | |
| 5,237,786 | A | | 8/1993 | Kochansky | |
| 5,694,729 | A | * | 12/1997 | Blackburn | E04B 2/7425 52/712 |
| 2011/0296789 | A1 | | 12/2011 | Collins et al. | |
| 2015/0337547 | A1 | | 11/2015 | Richardson et al. | |

FOREIGN PATENT DOCUMENTS

| | | | |
|---|---|---|---|
| EP | 2679739 | A2 | 1/2014 |
| JP | 2001254454 | A | 9/2001 |
| JP | 2001279861 | A | 10/2001 |
| JP | 2008050929 | A | 3/2008 |
| WO | 2014008536 | A1 | 1/2014 |

OTHER PUBLICATIONS

International Search Report & Written Opinion dated Apr. 16, 2020 from PCT Application No. PCT/AU2020/050170.
International-type search for provisional patent application dated Jun. 28, 2019 from Application No. 2019900637.

* cited by examiner

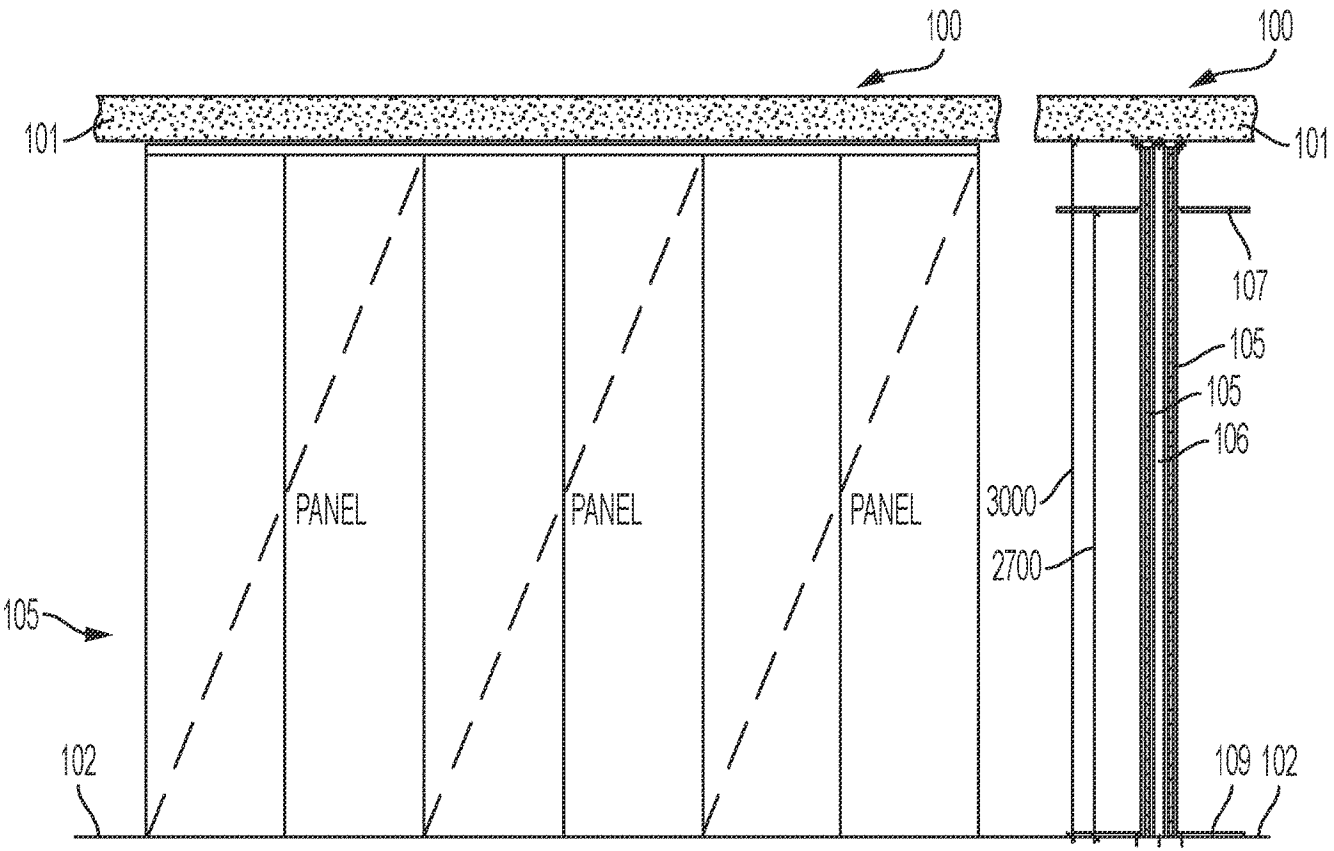
FIG. 2
FIG. 1
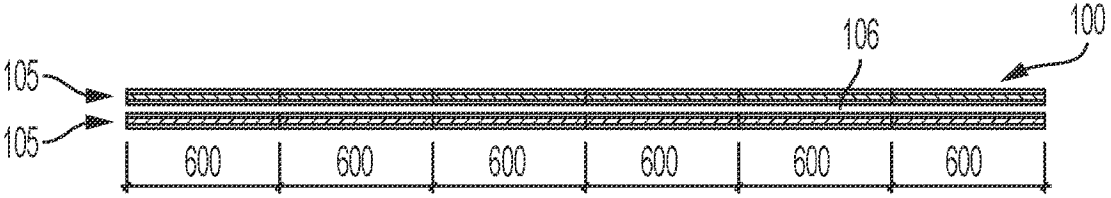
FIG. 3

INTER-TENANCY PARTITIONING SYSTEM

FIELD OF THE INVENTION

This invention relates generally to an inter-tenancy partitioning system.

SUMMARY OF THE DISCLOSURE

There is provided herein an inter-tenancy partitioning system installed between floor and ceiling slabs.

The system comprises aligned dual spaced apart ceiling and floor channels, each channel formed between inner edges of longitudinal channel forming members.

The channel forming members of the dual ceiling channels are affixed to an undersurface of the ceiling slab and the channel forming members of the dual floor channels are affixed to an upper surface of the floor slab.

Dual spaced-apart panels are supported vertically within the aligned dual ceiling and floor channels and a plurality of panels are run along each channel to complete a partition section. Each panel has a width less than that of each channel so as to be able to slide longitudinally for the packing together of adjacent panels in each channel during installation.

Furthermore, the dual ceiling and floor channels are spaced apart to provide a gap between the inner surfaces of the panels for the reticulation of requisite data, electrical and/or plumbing services therebetween.

The dual panels have a height of greater than 2800 mm and extend through a suspended ceiling to engage the respective channel forming members at the ceiling slab above the suspended ceiling in a concealed manner.

Furthermore, outer vertical pieces of the channel forming members of the floor channels have a height to not extend vertically beyond an upper surface of an adjacent floor covering.

The panels may comprise outer plasterboard layers which may be painted directly post installation without further preparation. The panels may comprise an inner fire rated core, such as of rockwool.

The channel forming members may comprise right-angled brackets. Horizontal pieces of inner right-angled brackets may overlap and may share a common fastener located through respective collocating apertures thereof.

Horizontal pieces of the channel forming members of the floor channels may extend laterally underneath the adjacent floor covering.

Whereas outer right-angled brackets of the channel forming members of the ceiling channels may be the same size as the inner channel forming members, the outer right-angled brackets of the channel forming members of the floor channels may be relatively smaller in having a relatively shorter vertical piece which does not extend above an upper surface of an adjacent floor covering. In one embodiment, the relatively smaller right-angled bracket has a height of 10 mm and a width of 40 mm so as to not extend above an adjacent floor covering which may be approximately 15 mm thick.

Installation of the system may comprise fixing four inner right-angled brackets to the ceiling and floor slabs. Two relatively larger outer right-angled brackets may be affixed to the ceiling whereafter the panels may be installed vertically with requisite services reticulated within the gap therebetween.

Thereafter, the relatively smaller outer right-angled brackets of the floor channel forming formations may be installed.

The panels may be slid adjacently within the channels until flush. Dual directional fastening pins apply to adjacent edges of each panel may pierce through the adjacent edges to bind the panels when the panels are pushed together.

The outer plasterboard layers of the panels may then be painted. The suspended ceiling may then be installed, thereby concealing the upper channel forming members thereabove and a floor covering may be installed to conceal the outer right-angled brackets of the channel forming members of the floor channels.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which:

FIG. 1 shows a front elevation view of an inter-tenancy partitioning system in accordance with an embodiment;

FIG. 2 shows a side elevation view of the partitioning system;

FIG. 3 shows a top plan view of the partitioning system;

DESCRIPTION OF EMBODIMENTS

Figure 5:
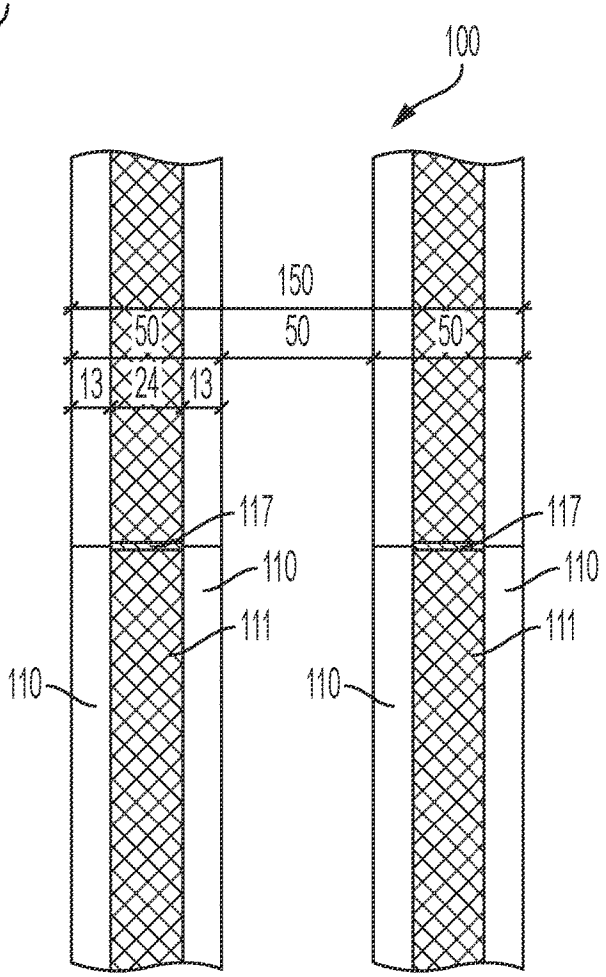
FIG. 5 shows a magnified view of adjacent edges of panels of the partitioning system.
Figure 4:
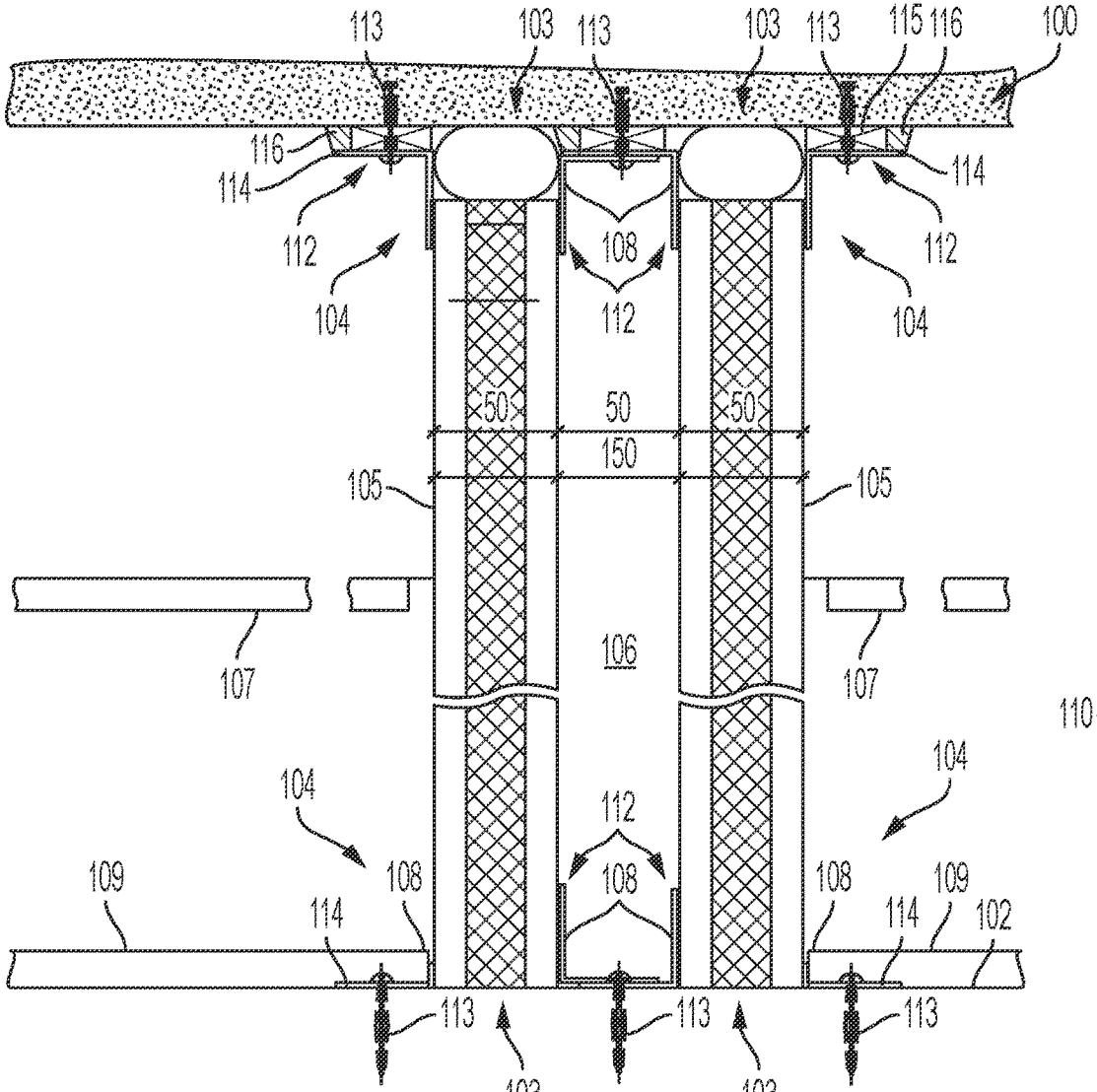
FIG. 4 shows a magnified cross-sectional side elevation view of the partitioning system.

An inter-tenancy partitioning system 100 is installed between a ceiling slab 101 and a floor slab 102.

The system 100 comprises dual ceiling and floor channels 103. Each channel 103 is formed between inner edges of longitudinal channel forming members 104.

The channel forming members 104 of the dual ceiling channels 103 are affixed to an undersurface of the ceiling slab 101 and the channel forming members 104 of the dual floor channels 103 are affixed to an upper surface of the floor slab 102.

Dual spaced apart partitioning panels 105 are supported vertically within the dual ceiling and floor channels 103. A plurality of panels 105 are run adjacently within each channel 103 to complete a partition.

Each panel 105 has a width less than that of each channel 103 so as to be able to slide longitudinally within the channels 103 during installation.

The dual ceiling and floor channels 103 are spaced apart to provide a services gap 106 between the panels 105.

The dual panels 105 have a height of greater than 2800 mm to extend through a suspended ceiling 107 to engage the respective channel forming members 104 thereabove in a concealed manner.

Furthermore, outer vertical pieces 108 of the channel forming members 104 of the floor channels 103 may have a length not extend vertically above an upper surface of an adjacent floor covering 109.

The panels may comprise outer plasterboard layers 110 and an inner core 111. The core 111 is preferably fire rated and may comprise rockwool.

Each panel 105 may comprise a width of approximately 50 mm wherein the outer plasterboard layers 110 have a width of approximately 13 mm and the inner core has a width of approximately 24 mm.

The dual channels 103 may be spaced apart to allow a gap 106 of approximately 50 mm between inner surfaces of the panels 105. In this configuration, the system 100 has a width of approximately 150 mm between outer surfaces of the panels 105.

The channel forming members 104 may comprise right-angled brackets 112.

Horizontal pieces 114 of the inner right-angled brackets 112 may overlap and may share a common fastener 113 through collocating apertures thereof. The horizontal pieces 114 of the outer right-angled brackets 112 may each be engaged by a respective separate fastener 113 therethrough.

Outer right-angled brackets 112 of the channel forming members 104 of the ceiling channels 103 may be of the same size as those of the inner right-angled brackets 112. In embodiments, these right-angled brackets 112 are 40×40 mm and 2 mm thick. The vertical pieces 108 of this length provide height tolerance between upper edges of the panels 105 and the ceiling slab 101. However, if necessary, spacers 115 may space the horizontal pieces 114 of right-angled brackets 112 of the channel forming members 104 of the ceiling channels 103 away from the undersurface of the ceiling slab 101. Fire rated sealant 116 (such as fire rated silicon) may interface edges of the spacers 115.

Vertical pieces 108 of the outer right-angled brackets 112 of the channel forming members 104 of the floor channels 103 may be relatively smaller which are thereby concealed between the upper surface of the adjacent floor covering 109. In embodiments, these relatively smaller right-angled brackets are 40×10 mm and 2 mm thick.

The horizontal pieces 114 of the outer right-angled brackets 112 of the channel forming members 104 may extend laterally to be concealed under the adjacent floor covering 109.

With reference to FIG. 3, each panel 105 may comprise a width of 1200 mm and, further with reference to FIG. 2, may comprise a height of approximately 3000 mm.

Installation of the system 100 may comprise applying 4-hour fire rated silicon to perimeters of the inter-tenancy wall. Furthermore, fire rated silicon sealant 117 may be applied to vertical edges of each panel 105. Dual direction fastening pins such as inter-tenancy panel rigidity pins may be applied to edges of each panel 105.

The four inner right-angled brackets 114 may be installed first into the ceiling and floor slabs using a Ramset™ or shot fire gun.

Thereafter, the two outer channel forming members may be installed in a similar manner.

The panels 105 may then be installed vertically with requisite services run within the gap 106 therebetween. Thereafter, the outer right-angled brackets 112 of the channel forming members of the floor channels are installed.

The panels 112 may be pushed longitudinally within the channels 103 against each other causing the panel rigidity pins and the adhesive 117 to bind.

Thereafter, the full parameter of the inter-tenancy wall may be sealed with fire rated silicon adhesive.

Outer surfaces of the outer plasterboard layers 110 of the panels 105 may be painted and the suspended ceiling 107 installed to conceal the upper channel forming members 104 and floor covering 109 installed to conceal the outer right-angled brackets 112 on the floor.

Figure 6:
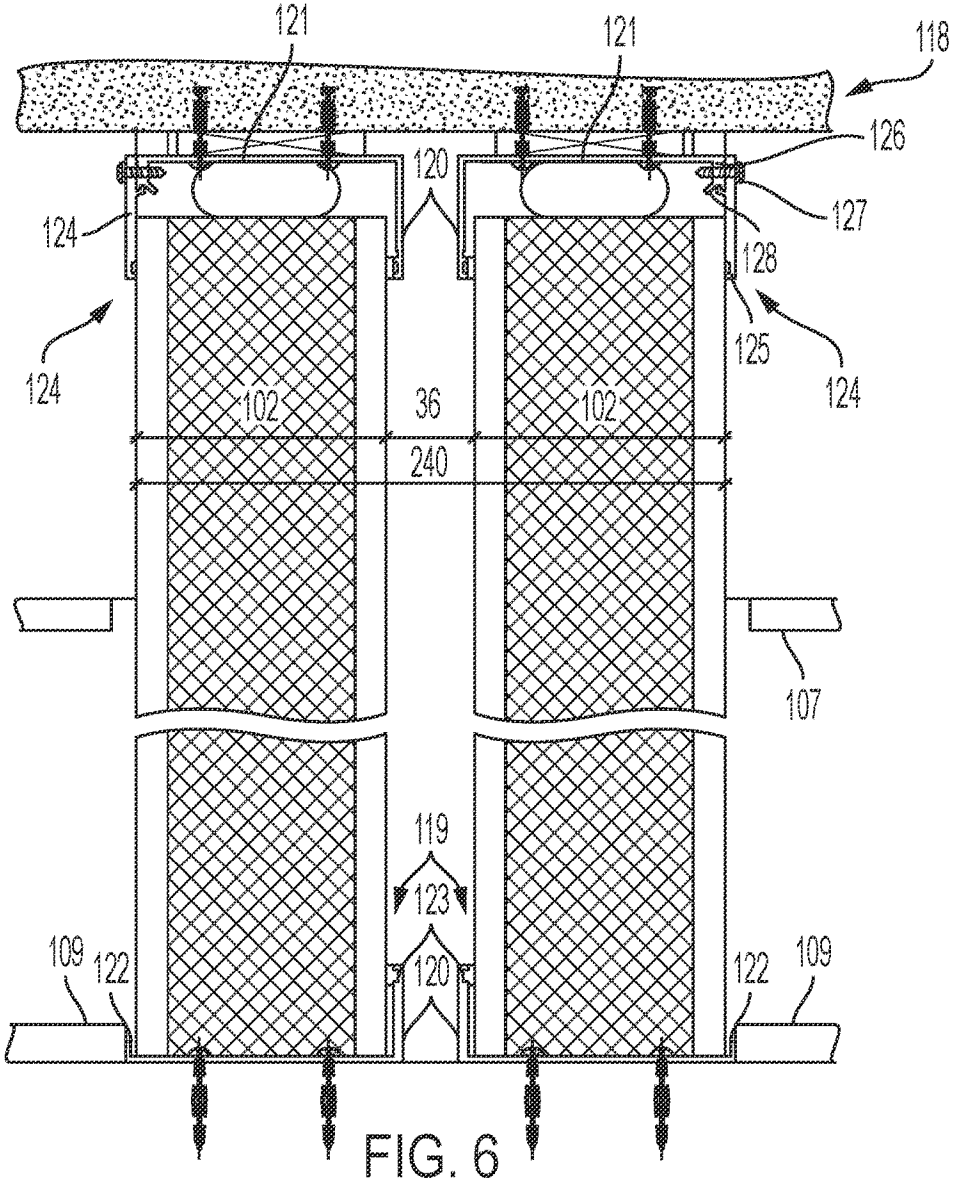
FIG. 6 shows a side elevation view of a partitioning system in accordance with a further embodiment.

FIG. 6 shows a partitioning system 118 in accordance with a further embodiment wherein the system 100 employs C-channels instead of right-angled brackets 112. In accordance with this embodiment, the system 100 may comprise floor C-channels 119 comprising vertical pieces 120, horizontal pieces 121 and outer vertical pieces 122.

Similarly, the outer vertical pieces 122 may comprise a length so as to remain concealed between an upper surface of an adjacent floor covering 109. Dual fasteners may locate through the horizontal pieces 121. Gaskets 123 may interface inner faces of the inner vertical pieces 120.

The system 118 may further comprise ceiling C-channels similar comprising a vertical piece 120 and horizontal piece 121. However, the outer vertical piece 125 may be removable.

An outer engagement 126 may engage a fastener 127 through upper edges of the removable vertical pieces 125. A claw arrangement 128 may further brace the removable vertical piece 125 against the fastener 127. Removal of the removable vertical pieces 125 may allow the panels 105 to be tilted from or into the upper channels 103.

Figure 7:
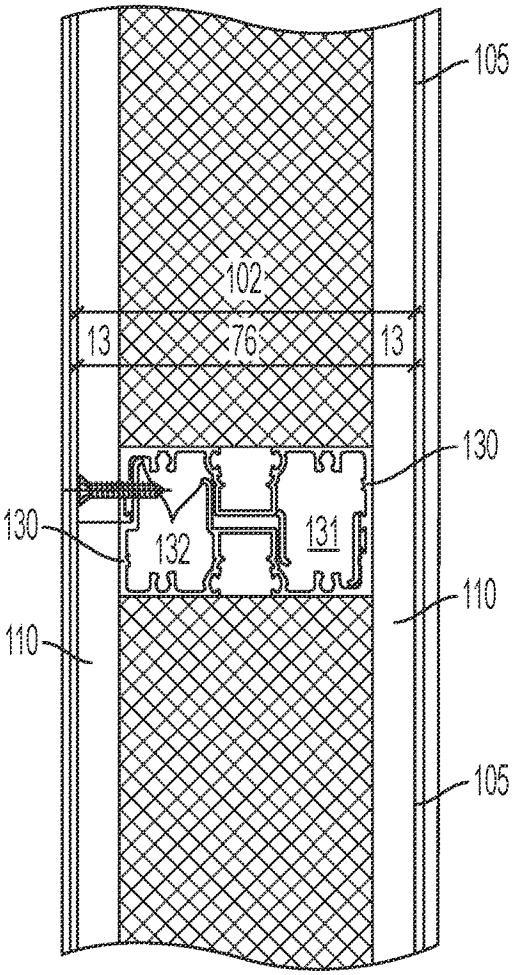
FIG. 7 shows a top plan view of panel interlocks in accordance with an embodiment.

FIG. 7 shows an inter-panel interlock 129 for interlocking adjacent edges of panels 105 together. Interlock 129 comprises a first interlock piece 130 and a second interlock piece 130. Each interlock piece 130 comprises a female region 131 and adjacent male tines 132. The pieces 130 are secured against adjacent edges of the panels 105 opposite-handedly such that the male tines 132 extend in to clip into the collocating respective female regions 131.

The pieces 130 may be made of metal, such as extruded aluminium.

The pieces 130 may allow the panels 105 to slide together longitudinally along the channels 103 yet prevent lateral movement when interlock together, thereby ensuring that the outer surfaces of the panels 105 are aligned.

The outer layers 110 may extend beyond the interlocking pieces 130 such that the interlocking pieces 130 concealed there behind when the panels 105 are pushed together.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. An inter-tenancy partitioning system installed between floor and ceiling slabs, the system comprising aligned dual spaced apart ceiling and floor channels, each channel formed between inner edges of longitudinal channel forming members, the channel forming members of the dual ceiling channels affixed at an undersurface of the ceiling slab and the channel forming members of the dual floor channels affixed at an upper surface of the floor slab, dual panels supported vertically within the aligned dual ceiling and floor channels, each panel having a width less than that of each channel, the dual ceiling and floor channels spaced apart to provide a gap between the panels and wherein the dual panels have a height of greater than 2800 mm and extend through a suspended ceiling to engage the respective channel forming members at the ceiling slab above the suspended ceiling and wherein adjacent floor covering is installed and wherein outer vertical pieces of the channel forming members of the floor channels have a height that does not extend vertically beyond an upper surface of the adjacent floor covering and wherein the channel forming members of the ceiling channels comprise C-channels each comprising a vertical piece, a horizontal piece and an outer vertical piece and wherein the outer vertical piece is removable from the horizontal piece and wherein the channel comprises an outer engagement which engages a fastener through an upper edge of the outer vertical piece and wherein a claw interlock acts against the fastener.

2. The system as claimed in claim 1, wherein the channel forming members of the floor channels comprise C-channels.

3. The system as claimed in claim 1, wherein the panels comprise outer plasterboard layers and an inner core.

4. The system as claimed in claim 3, wherein the inner core comprises rockwool.

5. The system as claimed in claim 3, wherein the outer plasterboard layers comprise a thickness of approximately 13 mm each and the inner core comprises a thickness of approximately 24 mm.

6. The system as claimed in claim 1, wherein each panel comprises a height of approximately 3000 mm.

7. The system as claimed in claim 1, further comprising dual direction fastening pins applied to adjacent edges of the panels which pierce into the adjacent edges when adjacent panels are pushed together within the channels in use.

8. The system as claimed in claim 1, further comprising fire rated adhesive applied to adjacent edges of the panels.

9. The system as claimed in claim 2, wherein C-channels of the floor channels comprise inner vertical pieces, horizontal pieces and outer vertical pieces and wherein the outer vertical pieces are smaller than the inner vertical pieces.

10. The system as claimed in claim 9, wherein the outer vertical pieces comprise a height of less than 10 mm.

11. The system as claimed in claim 1, further comprising an inter-panel interlock for interlocking adjacent edges of the panels together, each interlock comprising a first interlock piece and a second interlock piece, each interlock piece comprising a female region and adjacent male tines and wherein the pieces are secured against the adjacent edges of the panels, wherein the panels are complimentary when flipped or rotated so they work in cooperation.

12. The system as claimed in claim 11, wherein the panels comprise outer layers that extend over a portion of the interlocking pieces such that the interlocking pieces are concealed therebehind when the panels are pushed together.

13. The method of erecting an inter-tenancy partitioning system using the system as claimed in claim 1, the method comprising installing inner channel forming members in a spaced apart configuration, securing a series of dual panels thereagainst with outer channel forming members, installing a suspended ceiling to conceal the channel forming members at the ceiling slab and installing a floor covering to conceal outer channel forming members at the floor slab.

14. An inter-tenancy partitioning system installed between floor and ceiling slabs, the system comprising aligned dual spaced apart ceiling and floor channels, each channel formed between inner edges of longitudinal channel forming members, the channel forming members of the dual ceiling channels affixed at an undersurface of the ceiling slab and the channel forming members of the dual floor channels affixed at an upper surface of the floor slab, dual panels supported vertically within the aligned dual ceiling and floor channels, each panel having a width less than that of each channel, the dual ceiling and floor channels spaced apart to provide a gap between the panels and wherein the dual panels have a height of greater than 2800 mm and extend through a suspended ceiling to engage the respective channel forming members at the ceiling slab above the suspended ceiling and wherein adjacent floor covering is installed and wherein outer vertical pieces of the channel forming members of the floor channels have a height that does not extend vertically beyond an upper surface of the adjacent floor covering and wherein the channel forming members of the ceiling channels comprise C-channels each comprising a vertical piece, a horizontal piece and an outer vertical piece and wherein the outer vertical piece is removable from the horizontal piece and wherein dual direction fastening pins are applied to adjacent edges of the panels, the dual direction fastening pins pierce into the adjacent edges when adjacent panels are pushed together within the channels in use.

* * * * *